United States Patent [19]

Nakajima et al.

[11] 4,001,021

[45] Jan. 4, 1977

[54] LITHOGRAPHIC DEVELOPMENT OF A LITH-TYPE SILVER HALIDE EMULSIONS CONTAINING A BENZIMIDAZOLE

[75] Inventors: Tomio Nakajima, Tokyo; Teiji Habu, Kunitachi; Elichi Sakamoto, Hanno; Hiroshi Yamada, Hachioji; Katsuhide Mitsui, Hino; Eisaku Hayashi, Shizuoka, all of Japan

[73] Assignee: Konishiroku Photo Industry Co. Ltd., Japan

[22] Filed: Mar. 3, 1975

[21] Appl. No.: 554,924

Related U.S. Application Data

[63] Continuation-in-part of Ser. No. 372,420, June 21, 1973, abandoned.

[30] Foreign Application Priority Data

| | | |
|---|---|---|
| June 30, 1972 | Japan | 47-64958 |
| June 21, 1973 | United Kingdom | 29619/73 |
| June 27, 1973 | Germany | 2332754 |

[52] U.S. Cl. ..... 96/66 R; 96/95; 96/109; 96/107

[51] Int. Cl.[2] ..... G03C 1/06; G03C 5/20

[58] Field of Search ..... 96/107, 95, 109, 66.3, 96/66.5, 66 R

[56] References Cited

UNITED STATES PATENTS

| | | | |
|---|---|---|---|
| 3,271,154 | 9/1966 | Dersch et al. | 96/109 |
| 3,615,501 | 10/1971 | Shimamura et al. | 96/109 |
| 3,615,517 | 10/1971 | Milton et al. | 96/107 |
| 3,708,303 | 1/1973 | Salesin | 96/107 |
| 3,756,821 | 9/1973 | Hayashi et al. | 96/95 |
| 3,785,822 | 1/1974 | Overman | 96/107 |
| 3,895,948 | 7/1975 | Shiba et al. | 96/95 |

*Primary Examiner*—Won H. Louie, Jr.
*Attorney, Agent, or Firm*—Bierman & Bierman

[57] ABSTRACT

An improved lith-type silver halide photosensitive material of a wide latitude for infectious developing is disclosed which comprises, in an amount of 5 mg to 5 g per mole of silver halide, a compound represented by the following general formula:

wherein $R_1$ is a substituted or unsubstituted alkyl, aryl, aralkyl, arythio or aryloxy group, and $R_2$ is hydrogen, halogen, alkyl, alkoxy or nitro.

4 Claims, No Drawings

LITHOGRAPHIC DEVELOPMENT OF A LITH-TYPE SILVER HALIDE EMULSIONS CONTAINING A BENZIMIDAZOLE

This application is a continuation-in-part of application Ser. No. 372,420, filed June 21, 1973, which application claims the priority of Japanese Application No. 64958/1972 which was filed on June 30, 1972.

This invention relates to a lith-type silver halide photosensitive material. More particularly, the invention relates to a sensitized lith-type silver halide photosensitive material having a high contrast.

Lith-type silver halide photosensitive materials require photographic characteristics capable of forming a clear dot image of high contrast. In order to obtain such photographic characteristics, the photosensitive materials are generally developed by a special developer called an infectious developer which comprises hydroquinone as a main developer and has a low concentration of free sulfurous acid ions. Further, various additives have heretofore been used for improving such photographic characteristics of the silver halide photosensitive materials. A typical additive is a polyalkyleneoxide as disclosed in Journal of Photographic Science, 12, page 5 (1964).

The dot image-forming characteristics of lith-type silver halide photosensitive materials are easily affected by change of the development time, and even a very small change results in a great influence on the sharpness of minute dots. If polyalkyleneoxide is incorporated into a silver halide photo-sensitive material, though an image of high contrast can be obtained, the infectious development is inhibited and the sensitivity is greatly decreased, especially at the initial stage of development, so that a low dot density results therefrom. This is a fatal defect caused by the use of polyalkyleneoxide.

It is therefore a primary object of this invention to provide a sensitized lith-type silver halide photosensitive material which has an ability to form a clear and sharp dot image of high contrast, the photographic characteristics of which are not greatly affected by change in development time, even when treated by an infectious developer. In other words, the object is to provide a lith-type photosensitive material having a wide latitude for development. Another object of this invention is to provide a sensitized lith-type silver halide photosensitive material which has no desensitization in the initial development even when a polyakyleneoxide type compound is incorporated.

It has now been found that such objects and other advantages can be attained by incorporating a compound expressed by the following formula into a layer of a silver halide photosensitive material, such as an emulsion layer, a protective layer and/or an intermediate layer:

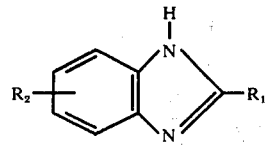

wherein $R_1$ is an alkyl, aryl, aralkyl, arylthio or aryloxy group, which group can have substituents such as hydroxy, halogen, nitro, alkoxy, alkyl and amine, and $R_2$ is hydrogen, halogen, alkyl, alkoxy or nitro.

A silver halide photosensitive material comprising a compound of the above general formula has a wide latitude for development when treated with an infectious developer to form a dot image. Therefore it is possible to conduct the development at a constant rate from the initial to the terminal stage. Further, the compound expressed by the above general formula is very effective for reducing desensitization at the initial development stage which desensitization is caused by incorporation of polyalkyleneoxide. The compound also has a high development-accelerating effect.

This development-promoting effect can commonly be observed regardless of the composition of the infectious developer used, and is especially conspicuous when the development is conducted by an infectious developer into which a preservative such as an aminocarboxylic acid resorcine or hydroxypyridazine is incorporated to prevent undesirable air oxidation of hydroquinone.

In case formation of a dot image is not required, a silver halide photosensitive material comprising a compound of the above general formula can be developed by a developer other than an infectious developer. For instance, a high contrast developer D-11 (by Eastman Kodak Co.) may be used as such. Even if such developer is employed, the sensitization owing to the high development-accelerating activity is similarly observed and formation of fog is effectively prevent to give a good image of high contrast.

The foregoing excellent effects can be obtained by the use of compounds expressed by the above general formula, and similar effects cannot be obtained by employing nitrogen-containing heterocyclic compounds having an "analogous" structure. For instance, when compounds similar to the compounds of the general formula are employed, a development-accelerating effect is observed, but the image contrast is drastically reduced, the dot quality is lowered and an image of good quality cannot be obtained. Typical instances of compounds of the above general formula to be used in this invention are given hereinafter:

| | | (M.P. °C) |
|---|---|---|
| (1) | 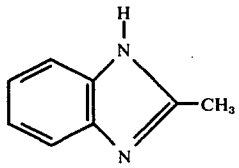 | 173 ~174 |

-continued
| | | (M.P. °C) |
|---|---|---|
| (2) | 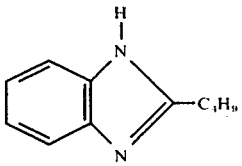 | 149 ~151 |
| (3) | 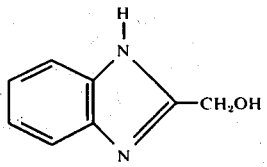 | 170.5~171.5 |
| (4) | 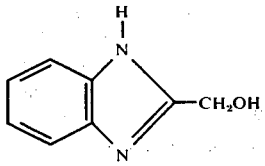 | 202 ~203 |
| (5) | 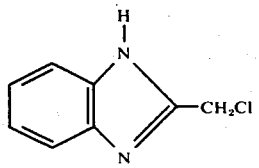 | 159 ~160 |
| (6) | 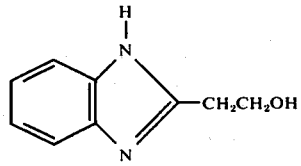 | 153.5~154.5 |
| (7) | 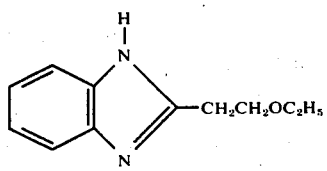 | 156.5~157 |
| (8) | 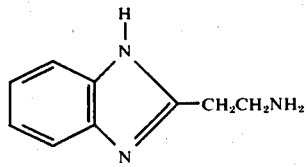 | 101.5 |
| (9) | 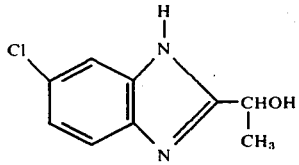 | 178 ~179 |
| (10) | 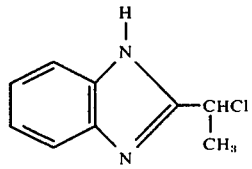 | 134 ~135 |

-continued
| | | (M.P. °C) |
|---|---|---|
| (11) | 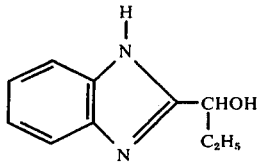 | 220 ~221 |
| (12) | 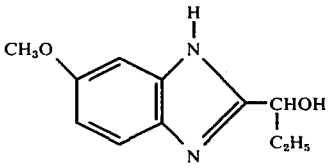 | 175 ~176 |
| (13) | 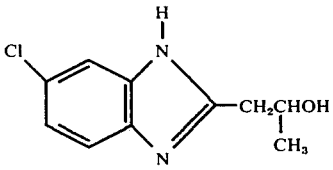 | 195 ~196 |
| (14) | 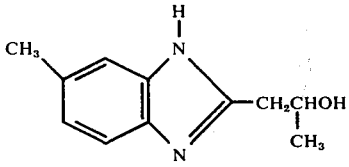 | 203 ~204 |
| (15) | 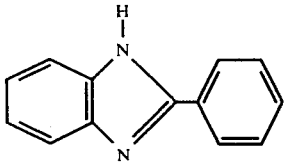 | 280 ~281 |
| (16) | 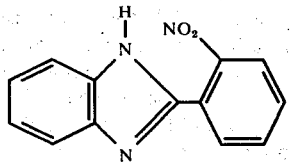 | 291 (decomposed) |
| (17) | 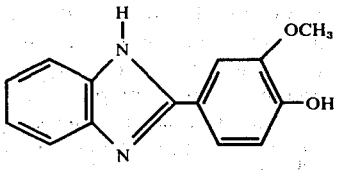 | 221 ~222 |
| (18) | 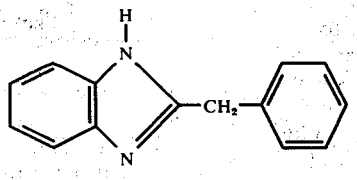 | 186.5~187 |
| (19) | 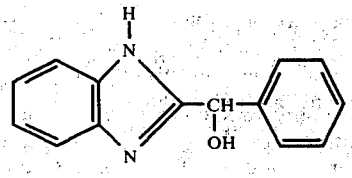 | 202 ~203 |

-continued

| | | (M.P. °C) |
|---|---|---|
| (20) | 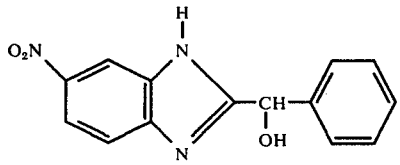 | 148 ~149.5 |
| (21) | 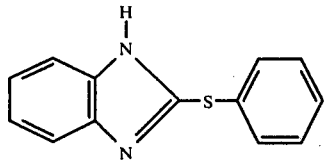 | 198 ~199 |
| (22) | 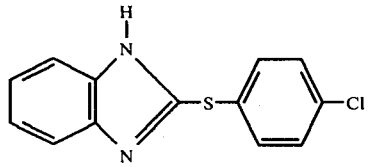 | 221 ~223 |
| (23) | 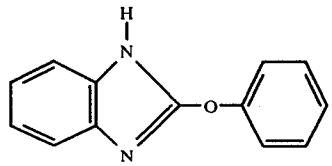 | 222 ~222 |
| (24) | 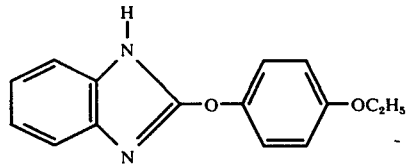 | 196.5~197.5 |

These compounds of the general formula can readily by synthesized by a general method comprising boiling (1) o-phenylene diamine and (2) an aliphatic or aromatic carboxylic acid, aldehyde or nitrile in diluted hydrochloric acid. Further, among these compounds, those having a 2-arylthio or 2-aryloxy group can easily be obtained by reacting a basic 2-chlorocompound with aryl mercaptan or phenol.

For instance, compounds (3) and (4) are synthesized by a method disclosed in Berichte, 45, page 3483 (1912), and compounds (2), (16) and (17) are synthesized by a method disclosed in Berichte, 69, page 2263 (1936). Compound (8) is synthesized by a method disclosed in Berichte, 84, page 719 (1951) and compounds (5) and (10) are synthesized by a method disclosed in the Journal of the American Chemical Society, 65, page 1854 (1943). Further, the Journal of the American Chemical Society, 71, page 1981 (1949) discloses a method for the syntheses of compounds (6) and (7). Compounds (1), (15) and (18) are synthesized by a method disclosed in the Journal of the American Chemical Society, 73, page 975 (1951) and compounds (9), (19) and (20) are synthesized by a method disclosed in the Journal of the American Chemical Society, 79, page 4391 (1957). Compounds (21), (22), (23) and (24) are synthesized by a method disclosed in Chemical and Pharmaceutical Bulletin, 85, page 962 (1965).

In order to incorporate such compounds into a silver halide photosensitive material, they are dissolved in water, a water-miscible organic slvent or a mixture thereof. The resulting solution is then added to a coating solution for a silver halide emulsion layer or an adjacent layer. Such an addition of the solution comprising those compounds may be conducted at an optional stage during the preparation of silver halide photosensitive material. For instance, if it is added to a silver halide emulsion layer, it is preferred that the addition be effected just after completion of the second ripening. The amount of such compound added varies depending on the kind of the silver halide emulsion, but it is generally preferred that the compound be added in an amount of about 5 mg to about 5 g per mole of silver halide. Emulsions containing various silver halides can be used for a silver halide photosensitive material of this invention.

For instance, emulsions can comprise a silver halide selected from silver bromide, silver bromochloride, silver chloride, silver bromochloroiodide and silver bromoiodide. These emulsions may be either of the negative type or the positive type. Of course, these emulsions may be subjected to chemical sensitization such as noble metal sensitization and sulfur sensitization. Further, these emulsions may comprise various photographic additives such as a stabilizer, a hardening agent, a wetting agent, a coating aid and a physical property-improving agent. They may also comprise an optical sensitizer such as a cyanine or merocyanine dye or a coupler for color photography.

The most preferred and effective emulsion is of the lith-type, which is usually combined with an infectious developer in the development treatment in order to obtain extremely high control images. This kind of emulsion generally comprises silver halide grains containing silver bromide of less than 65 mole percent and silver chloride of more than 35 mole percent when calculated based on total silver halides. Also the size of the silver halide grains is preferably about 0.1 – 1.5 $\mu$ in diameter.

The infectious developer is employed for effectively developing those kinds of emulsions in which hydroquinone is the main developer and the concentration of free sulfurous acid ions is very low. The development is customarily called an "infectious development" and is discussed in detail in Focal Encyclopedia of Photography published by McGraw-Hill Book Co. and The Theory of the Photographic Process edited by C.E. K. Mees and T. H. James.

When the compound of the above general formula is employed according to this invention, since desensitization is not caused at the initial development stage because of the foregoing development-accelerating effect, it is possible to add various polyalkyleneoxides to a silver halide emulsion. For instance, such polyalkyleneoxides as disclosed in U.S. Patents 2,886,437; 2,423,549; and Japanese Patent Publication No. 1382/68 can be used effectively in this invention.

This invention will now be illustrated in more detail by reference to the examples, but the scope of this invention is not limited thereby.

EXAMPLE 1

A lith-type silver bromochloroiodide emulsion (comprising silver halide grains of about 0.3 micron in average size) containing 60 mole percent of silver bromide and 0.5 percent of silver iodide, was subjected to the second ripening according to the gold sensitizing method and an optical sensitizing dye and polyalkyleneoxide [$nC_4H_9$—S—$(CH_2CH_2O)_{60}$—$COCH_2COOK$] as a tone-hardening agent was added to the emulsion in an amount of 150 mg per mole of silver halide. The resulting emulsion was divided into 6 portions, compounds (6), (7), (13) and (17), respectively, were incorporated into each of four such portions. Each of these compounds was added in an amount of 0.7 g per mole of silver halide in the form of a methanol solution. Lauryl pyridinium perchlorate (comparative compound A) disclosed in U.S. Pat. No. 2,886,437, was incorporated as a comparative nitrogen-containing heterocyclic compound in the same amount as that of the above compound into one of the remaining two portions of the emulsion. No compound was added to the remaining portion. Then, each of these 6 portions of the emulsion was incorporated with suitable amounts of a salt of 4-hydroxy-6-methyl-1,3,3a, 7-tetrazaindene as a stabilizer, mucochloric acid as a hardening agent and saponin as a coating aid, and then they were coated and dried under the suitable condition to obtain 6 samples.

These samples were subjected to wedge light exposure under 125 luxes (2660° K) with use of a sensitometer (model KS-IV manufactured by Konishiroku Photo Industry Co., Ltd.) partially equipped with a commercially available magenta contact screen, and the development was carried out at 20° C. for 3 minutes with use of a high contrast developer D-85 (from Eastman Kodak Co.). The photographic characteristics of these samples were examined to obtain results shown in Table 1.

In Table 1, the sensitivity is expressed by a relative value assuming that the sensitivity of sample No. 1 (containing no additive) is 100, and the contrast is expressed by the average gradient of the characteristic curve between the densities 0.1 and 2.0.

Table 1

| Sample No. | Compound | Amount Added (g per mole of silver halide) | relative Speed | Contrast |
|---|---|---|---|---|
| 1 | — | — | 100 | 4.2 |
| 2 | compound (6) | 0.7 | 129 | 5.3 |
| 3 | compound (7) | 0.7 | 120 | 6.5 |
| 4 | compound (13) | 0.7 | 125 | 6.0 |
| 5 | compound (17) | 0.7 | 118 | 5.8 |
| 6 | comparative compound A | 0.7 | 108 | 4.3 |

As is apparent from the results shown in Table 1, each of samples comprising compounds of this invention had a high speed and a high contrast, and clear dots of good quality were obtained in the portions exposed through the magenta contact screen.

EXAMPLE 2

In the same manner as described in Example 1, 7 samples were prepared by employing the same lith-type silver bromochloroiodide as used in Example 1 and by employing compounds (1) and (15) (instead of the compounds of the general formula used in Example 1) and hexadecyl pyridium bromide (comparative compound B) illustrated in U.S. Pat. No. 2,886,437 instead of the comparative compound A used in Example 1. Amounts used of these compounds were changed as indicated in Table 2.

The samples were exposed to light in the same manner as in Example 1, and the development was carried out at 27° C. for 1 minute and 20 seconds, 1 minute and 40 seconds, or 2 minutes with use of an infectious developer having the composition indicated below, to examine influences of the change in the development time on sensitivity, contrast and dot quality.

| Composition of Infectious Developer | | |
|---|---|---|
| Hydroquinone | 16 | g |
| Formaldehyde-sodium hydrogen sulfite adduct | 50 | g |
| Sodium sulfite | 2 | g |
| Boric acid | 2 | g |
| Potassium bromide | 1 | g |
| Sodium carbonate (monohydrate) | 60 | g |
| Triethylene glycol | 40 | g |
| 3,6-dihydroxypyridazine | 5 | g |
| Water to make | 1 | liter |

The results are shown in Table 2 in which the sensitivity is expressed as relative value calculated based on the sensitivity of sample 7 developed for 2 minutes being 100, and the contrast is expressed in the same manner as in Example 1.

The dot quality was evaluated in the following manner: A dot image formed at the portion exposed through the magenta contact screen was observed under a microscope, and the dot quality were evaluated according to a 5-graded rating method in which 5 indicates the sharpest dot image without fringes and rank 1 indicates a dot image full of fringes.

Table 2

| Sample No. | Compound | Amount Added (g per mole of silver halide) | relative speed 1'20" | relative speed 1'40" | relative speed 2'00" | Contrast 1'20" | Contrast 1'40" | Contrast 2'00" | Dot Quality 1'20" | Dot Quality 1'40" | Dot Quality 2'00" |
|---|---|---|---|---|---|---|---|---|---|---|---|
| 7 | — | — | 20 | 60 | 100 | 3.1 | 4.7 | 6.4 | 2 | 2 | 3 |
| 8 | compound (1) | 0.3 | 38 | 90 | 118 | 5.0 | 6.4 | 6.8 | 3 | 4 | 5 |
| 9 | compound (1) | 0.7 | 45 | 105 | 130 | 5.4 | 6.7 | 7.0 | 3 | 5 | 4 |
| 10 | compound (15) | 0.3 | 43 | 95 | 122 | 4.7 | 6.1 | 6.4 | 3 | 4 | 5 |
| 11 | compound (15) | 0.7 | 50 | 100 | 135 | 5.2 | 6.5 | 6.9 | 4 | 5 | 4 |
| 12 | Comparative compound B | 0.3 | 30 | 70 | 105 | 3.3 | 4.2 | 6.2 | 2 | 3 | 3 |
| 13 | Comparative compound B | 0.7 | 28 | 58 | 110 | 3.1 | 4.0 | 6.0 | 2 | 3 | 2 |

As is apparent from the results shown in Table 2, each of samples comprising compounds of this invention was excellent in relative speed, contrast and dot quality within a broad range of development time.

When each of samples was subjected to development treatment at 20° C. for 2 minutes by employing an ordinary high contrast developer (D-11 from Eastman Kodak Co.) instead of the above infectious developer, formation of fog was not observed and a very clear image was obtained when using the compounds of the present invention.

EXAMPLE 3

In the same manner as described in Example 1, 7 samples were prepared by employing a lith-type silver bromochloride emulsion(comprising silver halide grains of about 0.3 micron in average size containing 15 mole percent of silver bromide) and incorporating compounds (3), (5) and (18) therein instead of the compounds used in Example 1. The amounts used of these compounds were changed as indicated in Table 3.

These samples were exposed to light in the same manner as in Example 1, and the development was carried out at 27° C. for 1 minute and 40 seconds with the use of an infectious developer having the composition indicated below, to examine sensitivity, contrast and dot quality.

| Composition of Infectious Developer | |
|---|---|
| Hydroquinone | 17 g |
| Formaldehyde-sodium hydrogen sulfite adduct | 60 g |
| Sodium sulfite | 3 g |
| Boric acid | 2 g |
| Sodium carbonate(monohydrate) | 60 g |
| Potassium bromide | 1 g |
| Resorcine | 2 g |
| Water to make | 1 liter |

The results are shown in Table 3. The sensitivity is expressed as a relative value based on the sensitivity of sample 14 being 100, and the contrast value and dot quality are determined in the same manner as described in Example 2.

Table 3

| Sample No. | Compound | Amount Added (g per mole of silver halide) | relative speed | Contrast | Dot Quality |
|---|---|---|---|---|---|
| 14 | — | — | 100 | 5.3 | 3 |
| | compound (3) | 0.2 | 175 | 6.2 | 5 |
| | compound (3) | 0.6 | 190 | 6.0 | 4 |
| | compound (5) | 0.2 | 164 | 6.0 | 4 |
| | compound (5) | 0.6 | 182 | 5.8 | 4 |
| | compound (18) | 0.2 | 152 | 6.4 | 4 |
| | compound (18) | 0.6 | 140 | 6.5 | 5 |

As is apparent from the results shown in Table 3, samples comprising compounds of this invention had excellent photographic characteristics as lith-type photosensitive materials.

What is claimed is:

1. In a method for developing a lith-type silver halide material comprising silver halide grains containing silver bromide of less than 65 mole percent and silver chloride of more than 35 mole percent based on total silver halide, the size of the grains being 0.1 to 0.5 $\mu$ in diameter, which method comprises developing said photosensitive material which has been imagewise exposed to light by the use of an infectious developer, said developer comprising a silver halide developing agent consisting essentially of hydroquinone and (2) free sulfurous acid ions of very low concentration, the improvement which comprises said photosensitive material comprising, in an amount of 5 mg to 5 g per mole of silver halide, a compound represented by the following general formula:

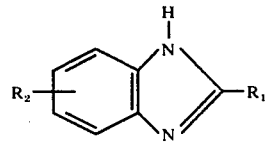

wherein $R_1$ is an alkyl, aryl, aralkyl, arylthio, or aryloxy group which can have hydroxy, halogen, nitro, alkoxy, amine and/or alkyl substituents and $R_2$ is hydrogen, halogen, alkyl, alkoxy or nitro.

2. The method according to claim 1 wherein $R_1$ is hydroxy alkyl and substituted or unsubstituted phenyl, while $R_2$ is hydrogen, chlorine, alkyl and alkoxy.

3. The method according to claim 2 wherein said substituted phenyl has hydroxy, halogen, nitro, and/or alkoxy as its substituents.

4. The method according to claim 1 wherein said photosensitive material further comprises polyalkylene oxide.

* * * * *